US011396730B2

(12) United States Patent
Hood

(10) Patent No.: US 11,396,730 B2
(45) Date of Patent: Jul. 26, 2022

(54) PORTABLE CIRCULATION DE-ICING SYSTEM

(71) Applicant: J2 Outdoors LLC, Smithton, MO (US)

(72) Inventor: Jeffrey L. Hood, Smithton, MO (US)

(73) Assignee: J2 Outdoors LLC, Smithton, MO (US)

( * ) Notice: Subject to any disclaimer, the term of this patent is extended or adjusted under 35 U.S.C. 154(b) by 0 days.

(21) Appl. No.: 16/892,672

(22) Filed: Jun. 4, 2020

(65) Prior Publication Data

US 2021/0381186 A1 Dec. 9, 2021

(51) Int. Cl.
*E02B 15/02* (2006.01)

(52) U.S. Cl.
CPC ..... *E02B 15/02* (2013.01)

(58) Field of Classification Search
CPC combination set(s) only.
See application file for complete search history.

(56) References Cited

U.S. PATENT DOCUMENTS 3,622,074 A * 11/1971 Frohwerk ..... F28C 3/06 239/11
5,017,093 A * 5/1991 Naes ..... E02B 1/003 405/61
5,441,368 A * 8/1995 Campbell ..... B63B 59/04 114/222
6,231,268 B1 * 5/2001 Hausenbauer ..... C02F 3/206 405/61
2004/0151485 A1 * 8/2004 Reusche ..... E02B 1/003 392/499
2008/0124230 A1 * 5/2008 Geremia ..... B01F 3/04609 417/365
2018/0251947 A1 * 9/2018 Stone ..... B01F 15/00175

FOREIGN PATENT DOCUMENTS

CH 692043 A5 * 1/2002 ..... C02F 7/00

* cited by examiner

*Primary Examiner* — Kyle Armstrong
(74) *Attorney, Agent, or Firm* — Shook, Hardy & Bacon L.L.P.

(57) ABSTRACT

A portable circulation de-icing system is configured to melt ice from a body of water having a surface ice layer and an underlying water layer, with an opening in the surface ice layer which may have been created by a user. The portable circulation de-icing system comprises an agitator assembly, a floating motor assembly, and a flexible drive shaft. The agitator assembly is configured to be at least partially placed into the underlying water layer through the opening. The agitator assembly is configured to induce a water flow into the underlying water layer. The floating motor assembly is configured to float on the underlying water layer in the opening and to provide rotational power. The flexible drive shaft is configured to transfer the rotational power from the floating motor assembly to the agitator assembly.

17 Claims, 10 Drawing Sheets

PORTABLE CIRCULATION DE-ICING SYSTEM

FIELD OF THE INVENTION

The present disclosure generally relates to the removal of ice from various bodies of water, and more specifically to boom-positioning mechanisms for agitation de-icing machines.

BACKGROUND

Ice forms naturally on various stagnant bodies of water during cold temperatures. In order for water to freeze into ice, heat loss must exceed the heat replaced. Thus, flowing water requires much lower temperatures in order to freeze. Further, stagnant water tends to freeze from the top down, with lower water remaining warmer as it is further from and insulated from the ambient air. Typically, the body of water forms a surface ice layer above an underlying liquid water layer. The rate of ice formation thus depends on various factors, such as the flow rate of the water, the ambient air temperature, the depth of the water.

For any of various applications, it may be desirable to remove at least a portion of the surface ice layer from a body of water. Conventional de-icing machines require a static installation and powering, such as the usage of a wired alternating current source. This limits the availability and practicality of existing de-icing machines.

This background discussion is intended to provide information related to the present invention which is not necessarily prior art.

BRIEF SUMMARY

Embodiments of the invention solve the above-mentioned problem (as well as other problems) by providing a portable circulation de-icing system capable of sustained usage in remote areas. The portable circulation de-icing system includes an agitator configured to be disposed in an underlying water layer, while being remotely powered by a floating motor. The floating motor imparts a rotation on a flexible drive shaft. The flexible drive shaft drives the agitator inducing a flow and thus melting a surface ice layer. The floating motor is configured to be disposed in the water near the agitator, so as to provide the power without being tied to a shore of the body of water.

A first embodiment of the invention is broadly directed to a portable circulation de-icing system configured to melt ice from a body of water having a surface ice layer and an underlying water layer, with an opening in the surface ice layer. The portable circulation de-icing system comprises an agitator assembly, a floating motor assembly, and a flexible drive shaft. The agitator assembly is configured to be at least partially placed into the underlying water layer through the opening. The agitator assembly is configured to induce a water flow into the underlying water layer. The floating motor assembly is configured to float on the underlying water layer in the opening and to provide rotational power. The flexible drive shaft is configured to transfer the rotational power from the floating motor assembly to the agitator assembly.

A second embodiment of the invention is broadly directed to a method of removing ice from a body of water having a surface ice layer and an underlying water layer, the method comprising: creating an opening in the surface ice layer; placing an agitator assembly at least partially into the underlying water layer; placing a floating motor assembly onto the underlying water layer in the opening, wherein the motor assembly is configured to provide rotational power to the agitator assembly via a flexible drive shaft; and starting the floating motor assembly such that the rotational power turns a propeller of the agitator assembly so as to induce a water flow into the underlying water layer such that the water flow removes ice from the surface ice layer.

A third embodiment of the invention is broadly directed to floating motor platform for a de-icing system. The floating motor platform comprises a float body, a fuel tank, and a motor mount. The fuel tank is disposed at least partially within the float body. The motor mount configured to receive a motor thereon for powering the de-icing machine.

Other embodiments of the invention may be broadly directed to a method of controlling a portable circulation de-icing system. Still other embodiments may be directed to an electronic control device configured to control the portable circulation de-icing system.

Advantages of these and other embodiments will become more apparent to those skilled in the art from the following description of the exemplary embodiments which have been shown and described by way of illustration. As will be realized, the present embodiments described herein may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of systems and methods disclosed therein. It should be understood that each Figure depicts an embodiment of a particular aspect of the disclosed systems and methods, and that each of the Figures is intended to accord with a possible embodiment thereof. Further, wherever possible, the following description refers to the reference numerals included in the following Figures, in which features depicted in multiple Figures are designated with consistent reference numerals. The present embodiments are not limited to the precise arrangements and instrumentalities shown in the Figures.

Figure 1:
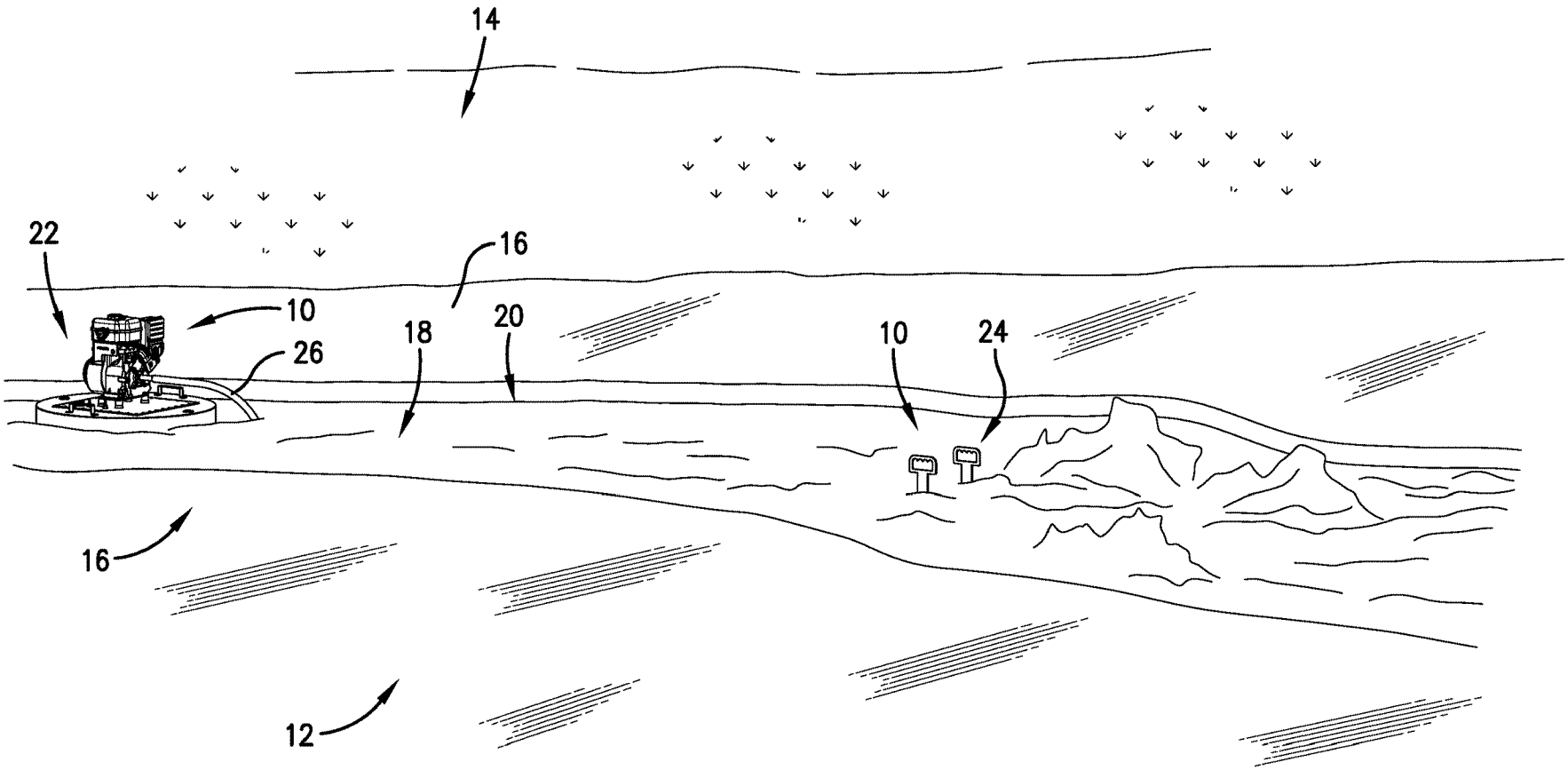
FIG. 1 is an exemplary environmental view showing usage of a portable circulation de-icing system at a body of water.

The Figures depict exemplary embodiments for purposes of illustration only. One skilled in the art will readily recognize from the following discussion that alternative embodiments of the systems and methods illustrated herein may be employed without departing from the principles of the invention described herein. While the drawings do not necessarily provide exact dimensions or tolerances for the illustrated components or structures, the drawings, not including any purely schematic drawings, are to scale with respect to the relationships between the components of the structures illustrated therein.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments. For instance, the drawing figures do not limit the present invention to the specific embodiments disclosed and described herein. Furthermore, directional references (for example, top, bottom, up, and down) are used herein solely for the sake of convenience and should be understood only in relation to each other. For instance, a component might in practice be oriented such that faces referred to as "top" and "bottom" are sideways, angled or inverted relative to the chosen frame of reference.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

Exemplary Environment and Usages

Embodiments of the invention may be utilized in any of various environments. An exemplary environment is shown in FIG. 1 and discussed below. However, it should be appreciated that this environment is only exemplary and that various embodiments of the invention may be utilized in other environments.

Turning to FIG. 1, an exemplary environment for embodiments of the invention is shown. A portable circulation de-icing system 10 is shown in use in the exemplary environment. The exemplary environment may include a body of water 12 surrounded by (or otherwise proximate to) a shore 14 or other terrain feature (such as a bank, an embankment, a dam, a levee, or the like). A body of water 12 can be any accumulation of water. Examples of the body of water 12 may include an ocean, a sea, a bay, a gulf, a lake, a pond, a river, a stream, a canal, or wetlands. The body of water 12 may be natural or man-made.

The body of water 12 may have a surface ice layer 16 above an underlying water layer 18. The surface ice layer 16 may include an opening 20 therein. The opening may have been manually created by a user and then enlarged and sustained by embodiments of the invention. The opening may be created via a pick, an axe, or other tool. Some embodiments of the invention may include one or more structures configured to create the opening in the surface ice layer.

The user may desire to remove all or a portion of the surface ice layer for any of various purposes. A first exemplary purpose is hunting. For example, in waterfowl hunting, the waterfowl will tend to land on liquid water such that the waterfowl may feed and swim in the water. If the waterfowl see a pond or lake with liquid water, the waterfowl are more likely to land on that pond or lake. This is advantageous for hunters of the waterfowl disposed on the shore 14 nearby or a boat on the liquid water. Decoys disposed on the liquid water may further bring in waterfowl. Thus, some embodiments of the invention are configured to be utilized by hunters in a pond or lake for waterfowl or other hunting purposes.

FIG. 1 shows the portable circulation de-icing system 10 in use for the first exemplary purpose. Shown is a floating motor assembly 22 separated from an agitator assembly 24. A flexible drive shaft 26 extends between the floating motor assembly 22 and the agitator assembly 24. Most of the agitator assembly 24 and the flexible drive shaft 26 are below the water line in FIG. 1. These components are discussed in much more depth below. In this exemplary purpose, a hunter will cut or break an opening in the ice that is sufficiently large to place the agitator assembly 24 through and the floating motor assembly 22 into the opening. The hunter will then start the floating motor assembly 22 such that the floating motor assembly 22 provides power to the agitator assembly 24 via the flexible drive shaft 26. The agitator assembly 24 will then generate a water flow so as reduce the surface ice layer. The reduced surface ice layer will enlarge the opening and/or start a new opening in the ice. The liquid water will attract waterfowl for the hunter.

A second exemplary purpose is for boating. A boat may become trapped in a sudden or unexpected ice layer. Utilizing tools (such as the above discussed pick or axe) proximate to the boat may be disadvantageous because an inadvertent strike can cause damage to the boat. Further, physically removing the ice (as opposed to melting the ice) can cause damage to the finishes and other aspects of the boat. Thus, some embodiments of the invention are configured to be utilized from a boat or dock for purposes of freeing a boat or other watercraft trapped in the ice.

A third exemplary purpose is for fishing. The sport of ice fishing typically utilizes a small hole cut into the surface ice layer. A fishing lure and fishing line of a fishing pole are lowered through the hole to catch fish. Thus, some embodiments of the invention may be utilized to make, enlarge, and/or sustain a hole for ice fishing.

A fourth exemplary purpose is for domesticated animals. Domesticated animals need to drink during the cold winter months. Ice forming on stock ponds and other bodies of water make this difficult for domesticated animals. Thus, some embodiments of the invention may be utilized to keep an opening in the ice of a stock pond such that the domesticated animals have a sustained source of water. In many instances, these stock ponds are in remote areas, away from other power sources. In such instances, embodiments of the invention may be utilized to bring de-icing to these remote areas.

A fifth exemplary purpose is for hatcheries. Hatcheries raise fish and other aquatic life. In order to feed the aquatic life, hatcheries may need to keep the ice open during cold weather. Embodiments of the invention may thus be used to keep the water accessible for feeding.

A sixth exemplary purpose is for the protection of water-based structures. Various permanent or temporary structures may become damaged (structurally and/or cosmetically) due to prolonged exposure to ice. Embodiments of the invention may thus be used to prevent ice that would damage adjacent structures. This may be used for remote structures away from other power sources.

A seventh exemplary purpose is for conservation projects. Conservation projects may include goals of keeping various wild animals with access to drinkable water, of ensuring the flow of water through certain natural or manmade terrain features, or of other purposes to prevent otherwise naturally occurring ice. Embodiments of the invention may be configured to be utilized in the remote areas for conservation.

It should be appreciated that while the portions of the description herein relate to the hunting exemplary purpose, various embodiments may be directed to other or multiple purposes. The hunting purpose is discussed to provide an understandable example to the reader.

Exemplary Portable Circulation De-Icing System

Figure 2:
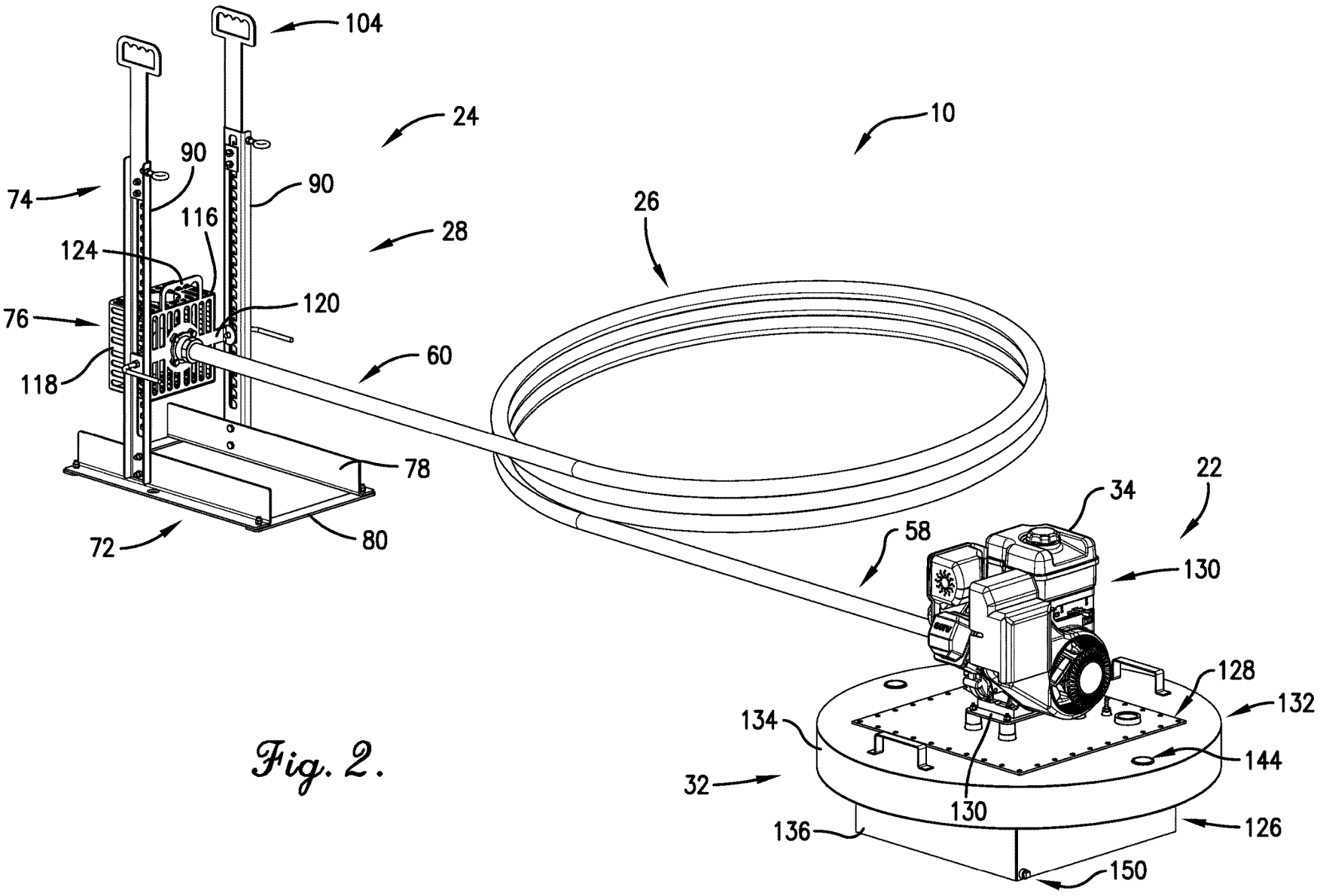
FIG. 2 is a perspective view showing an exemplary embodiment of the portable circulation de-icing system.
Figure 3:
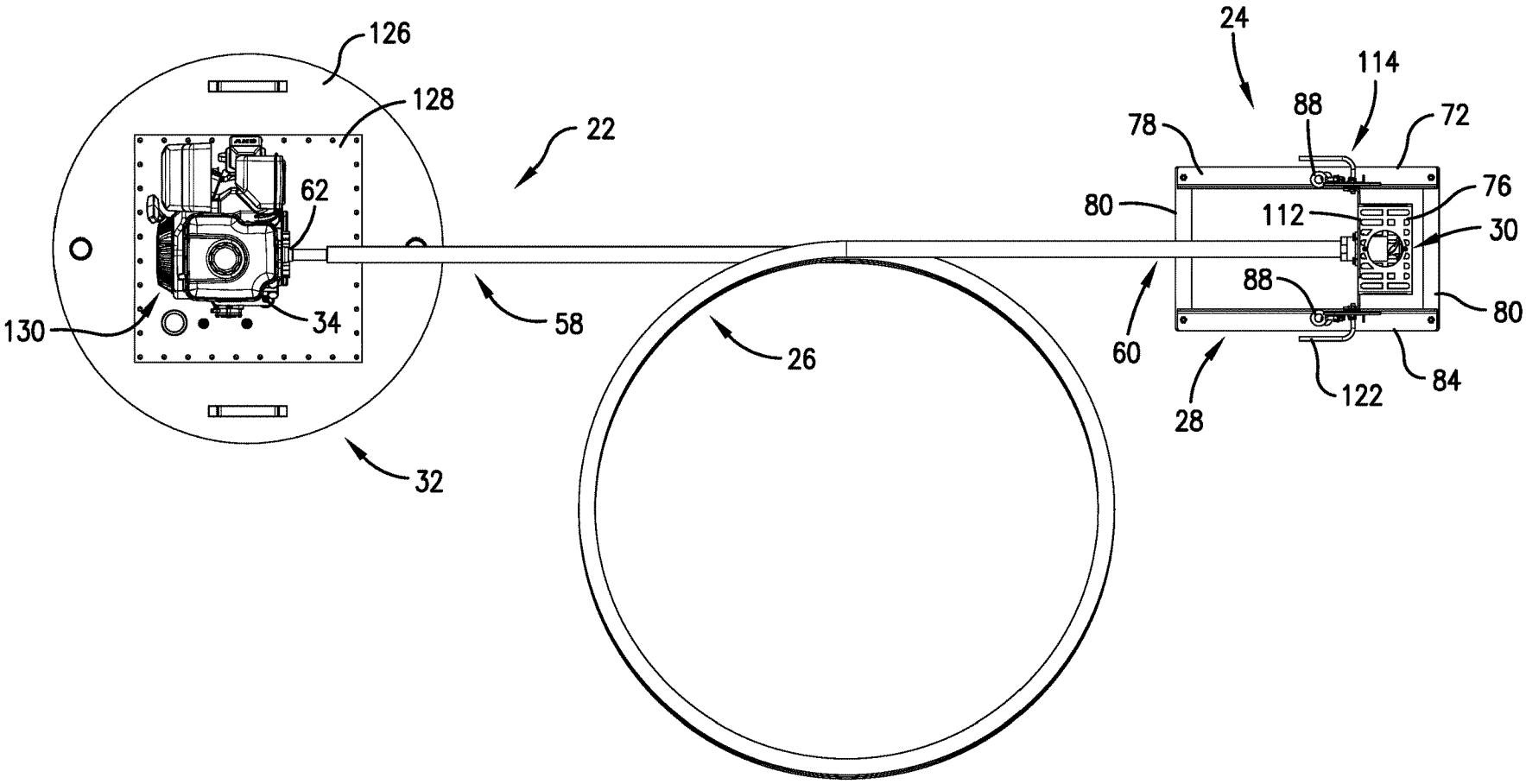
FIG. 3 is a top view of the exemplary embodiment of FIG. 2.
Figure 4:
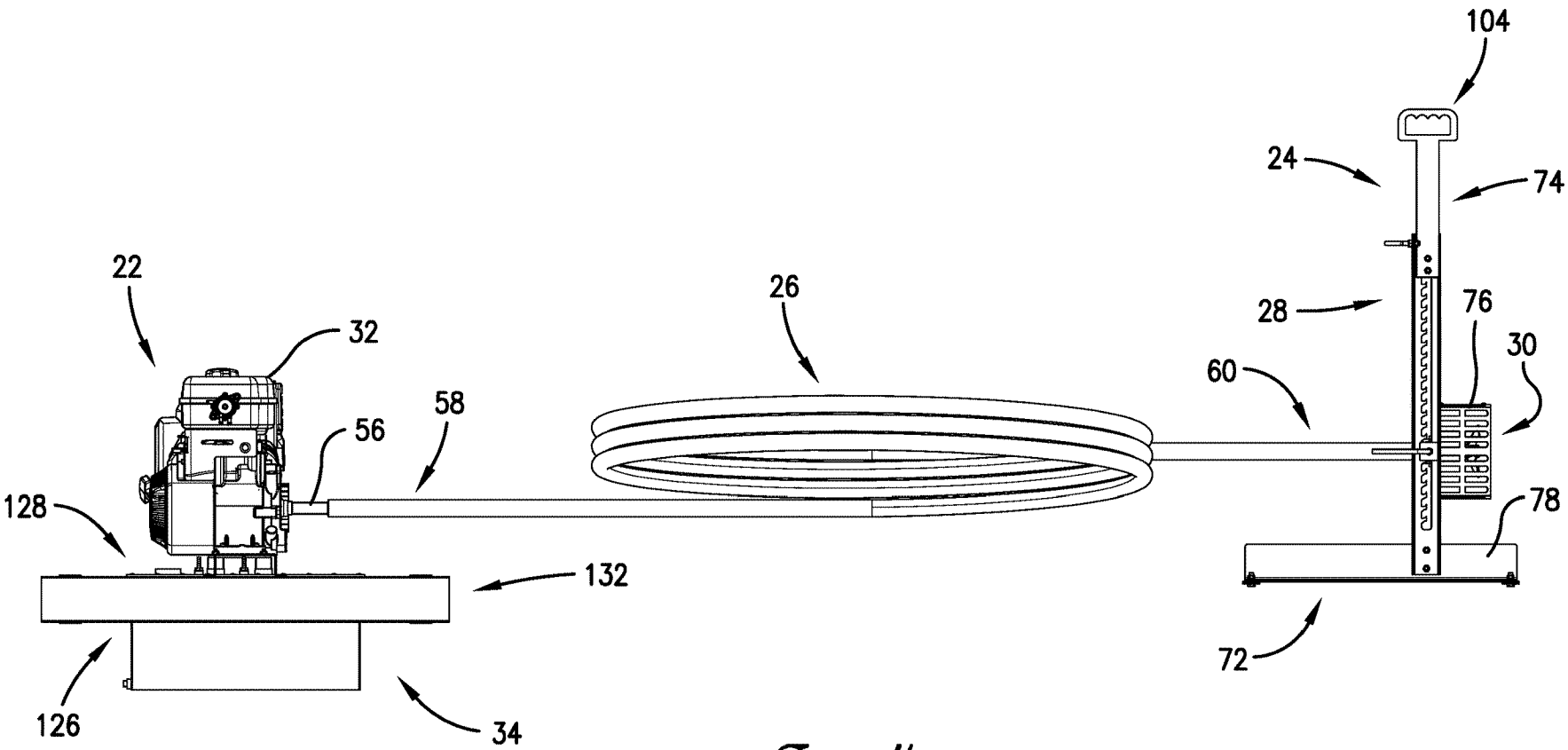
FIG. 4 is a side view of the exemplary embodiment of FIG. 2.

Turning to FIGS. 2-4, an exemplary embodiment of the portable circulation de-icing system 10 is shown from various views. FIG. 2 shows a perspective view of the portable circulation de-icing system 10 from an upper motor end. The flexible drive shaft 26 is shown coiled between the agitator assembly 24 and the floating motor assembly 22. FIG. 3 shows a top view of the portable circulation de-icing system 10. FIG. 4 shows a side view of the portable circulation de-icing system 10. It should be appreciated that the embodiment shown in these figures is only exemplary.

The portable circulation de-icing system 10 is configured to be carried (or otherwise transported) to a body of water 12 and operate independently. Specifically, in some embodiments, the portable circulation de-icing system 10 is configured to operate without external power or other tether. As such, a hunter or other operator may carry the portable circulation de-icing system 10 to the body of water 12 and setup up the portable circulation de-icing system 10 to de-ice all or any portion of the body of water 12. The hunter or other operator may carry the portable circulation de-icing system 10 in two or more distinct components that are assembled at the use site. For example, the hunter or other operator (or a group thereof) may carry the agitator assembly 24, the flexible drive shaft 26, and the floating motor assembly 22 separately. The hunter or other operator (or group thereof) may then reassemble the portable circulation de-icing system 10 in or adjacent to the opening for operations.

As discussed above, the portable circulation de-icing system 10 is utilized to deice a body of water 12. The portable circulation de-icing system 10 broadly includes the agitator assembly 24 and the floating motor assembly 22. The agitator assembly 24 is configured to be disposed at least partially below the underlying water layer (as shown in FIG. 1) and to rest on an underlying surface of the body of water 12. The agitator assembly 24 induces a water flow into the underlying water layer. Typically, the water flow will be angled upward so as to move the warmer water at the bottom of the underlying water layer upward to contact the surface ice layer.

The agitator assembly 24 broadly includes a base 28 and a propeller 30. The base 28 holds the propeller 30 at a certain height and attack angle relative to the underlying surface upon with the base 28 is setting. The propeller 30 is configured to be at least partially placed into the underlying water layer through the opening. The operating propeller 30 generates a water flow in the underlying water layer which will enlarge the opening, create a new opening, sustain the opening, etc.

The floating motor assembly 22 comprises a floating motor platform 32 and a motor 34. The floating motor platform 32 is configured to float on the surface of the underlying water layer such that the motor 34 is exposed to the air. The floating motor assembly 22 provides power to the agitator assembly 24 via the flexible drive shaft 26. In some embodiments, the floating motor assembly 22 is configured to provide rotational power, and the flexible drive shaft 26 is configured to transfer the rotational power from the floating motor assembly 22 to the agitator assembly 24.

Exemplary Agitator Assembly

Figure 5A:
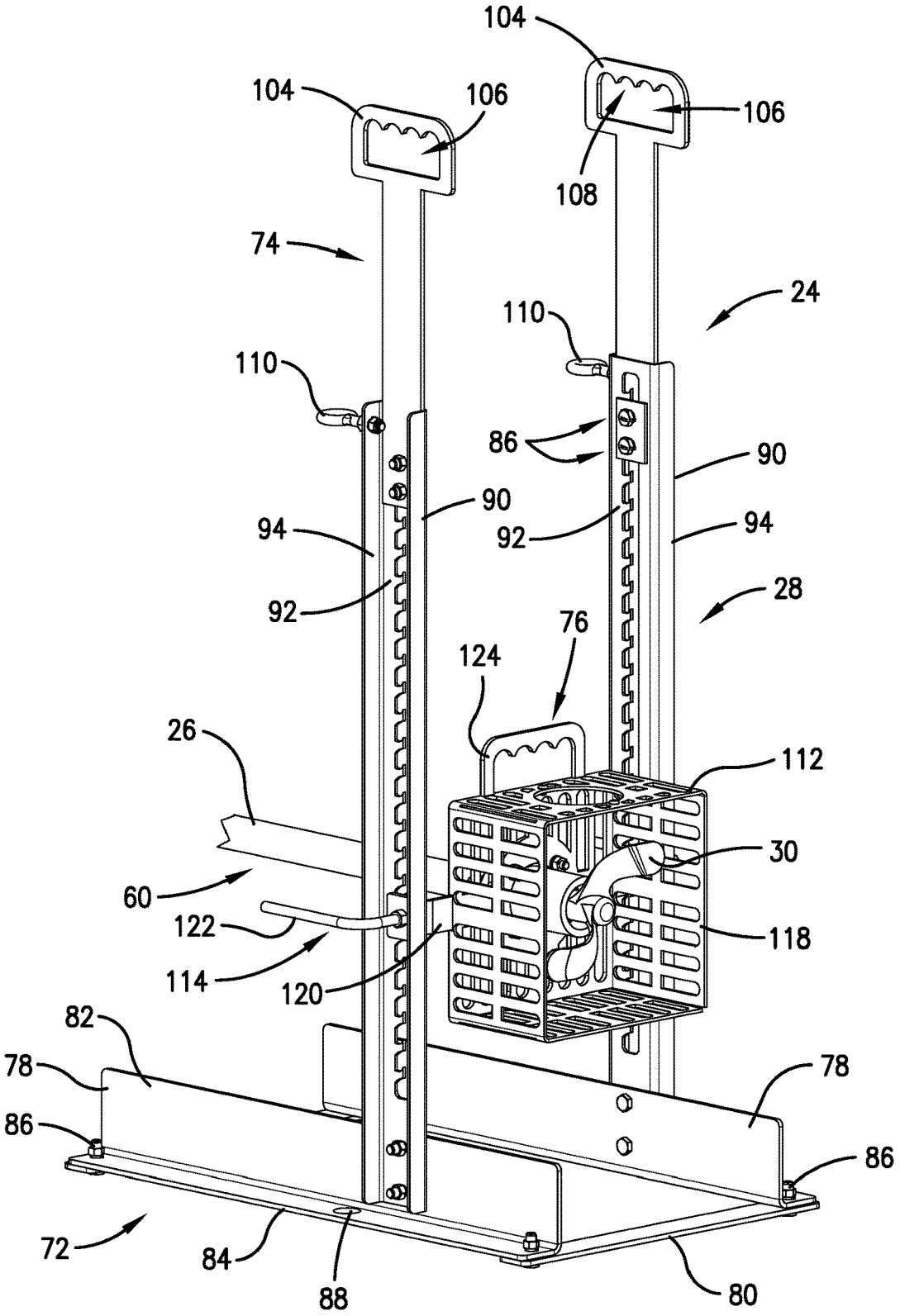
FIG. 5A is a detail perspective view of an agitation assembly of the portable circulation de-icing system.
Figure 6:
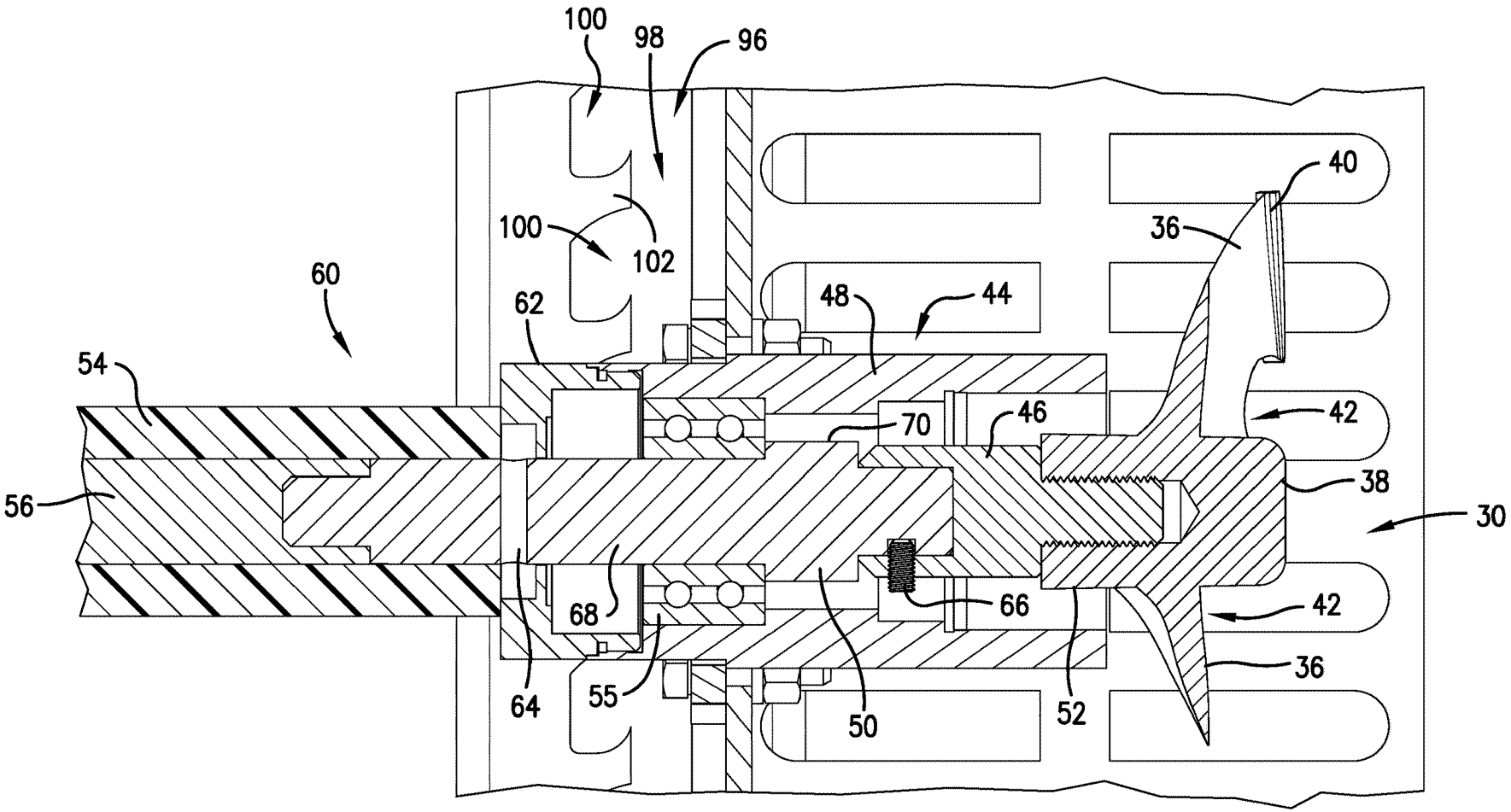
FIG. 6 is a vertical cross-section view of a propeller and powering system of the agitation assembly.

Turning now to FIGS. 5A and 6, the agitator assembly 24 is shown in more detail. The agitator assembly 24 includes the propeller 30 and the base 28. In embodiments of the invention, the agitator assembly 24 is separate and distinct from the floating motor assembly 22. The agitator assembly 24 is further configured to be moved independently of the floating motor assembly 22.

The propeller 30 is configured to be actuated by the rotational power from the floating motor assembly 22, as discussed more below. The propeller 30 rotates so as to induce a water flow in the underlying water layer of the body of water 12. The propeller 30 may be analogous to the propeller on a watercraft (such as a boat or submarine); however, instead of propelling the watercraft, the propeller 30 of embodiments of the invention propels the water in relation to an otherwise stationary propeller 30. The propelled water moves the warmer water into contact with the surface ice layer.

Turning to FIG. 6, a cross-sectional view of various components of the propeller 30 and the base 28 are shown. The propeller 30 includes one or more blades 36 extending from a hub 38. The blades 36 include a tip 40 at a distal end and a root 42 at a proximal end. The root 42 is secured to the hub 38. The blades 36 include a leading edge and a trailing edge. The leading edge is oriented forward during the rotation of the blade 36 about the hub 38. The blade 36 is disposed at an attack angle relative to the hub 38, configured to induce the water flow while the blade 36 rotates about the hub 38. The propeller 30 is rotatably secured to a propeller assembly 44 (best shown in FIG. 6), which may include a coupler 46, a collar 48, and an adapter shaft 50. The coupler 46 is secured to a boss 52 of the hub 38 of the propeller 30. The coupler 46 and the boss 52 may include a complementary threaded segment for securing thereof. The coupler 46 and the boss 52 are surrounded at least partially by the collar 48. The collar 48 may include one or more bearing 55 for facilitating the rotation of the coupler 46 and the propeller 30.

The propeller 30 is powered via the flexible drive shaft 26. The flexible drive shaft 26 generally includes a sheath 54 and an inner drive 56 (also shown in FIG. 4). The inner drive 56 is disposed within the sheath 54 and is configured to convey a rotation imparted on a proximal end 58 (e.g., a motor end) to a distal end 60 (e.g., a propeller end). Thus, the inner drive 56 rotates within the sheath 54 via the motor 34. The distal end 60 of the flexible drive shaft 26 (best shown in FIG. 6) includes a shaft coupler 62 and a securing pin 64. The shaft coupler 62 is configured to secure the distal end 60 of the flexible drive shaft 26 to the propeller 30 (directly or indirectly, such as to the adapter shaft 50) The proximal end 58 of the flexible drive shaft 26 (best shown in FIG. 5B) may also include a shaft coupler 62 or other structure for securing the flexible drive shaft 26 to the motor 34. The shaft couplers 62 may secure to the propeller 30 and/or motor 34, such as via the securing pin 64.

As shown in FIG. 6, the flexible drive shaft 26 is configured to be secured indirectly to the propeller 30. In embodiments, the flexible drive shaft 26 turns the adapter shaft 50.

The adapter shaft 50 is disposed at least partially within the collar 48, such as between the bearing 55. The adapter shaft 50 is secured to the coupler 46 via a set screw 66. The set screw 66 keeps the adapter shaft 50 radially aligned with the coupler 46 and the propeller 30. The adapter shaft 50 includes a generally elongated body 68 with a radial extension 70. The radial extension 70 nests with the bearing 55 to keep the adapter shaft 50 freely spinning and secured within the collar 48.

It should be appreciated that the design of FIG. 6 is only exemplary and that other structures configured to transfer the rotation could also be employed in other embodiments of the invention.

The base 28, as best shown in FIG. 5A, includes a horizontal segment 72, a vertical extension 74, and a propeller housing 76. The base 28 supports the propeller 30 above an underlying surface below the underlying water layer. The horizontal segment 72 is configured to rest on the underlying surface. The horizontal segment 72 keeps the base 28 generally secured against the underlying surface, such as via friction. The vertical extension 74 extends upward from the horizontal segment 72. The vertical extension 74 provides a separation between propeller 30 and the underlying surface. The propeller housing 76 protects the propeller 30 from various floating debris. Absent the propeller housing 76, the induced water flow would draw in the debris into the propeller 30. This may cause damage to the rapidly rotating propeller 30. The propeller housing 76 may also interface with the vertical extension 74 to set a height and an attack angle relative to the horizontal segment 72 and/or the underlying surface. Thus, in embodiments, the base 28 is configured to hold the propeller 30 at an adjustable set height above the underlying surface. Further, in embodiments, the base 28 is configured to hold the propeller 30 at an adjustable set attack angle relative to the underlying surface.

The horizontal segment 72 is configured to be placed against and remain generally in contact with the underlying surface of the body of water 12. In embodiments, the horizontal segment 72 comprises a left and a right stabilizer 78, and a front and a rear strut 80 (best illustrated in FIGS. 2 and 3). The left stabilizer 78 and the right stabilizer 78 (which may be referred to generically as a first stabilizer and a second stabilizer) are separated from one another via the front strut 80 and the rear strut 80 (which may be referred to generically as a first strut and a second strut). The horizontal segment 72 thus presents a generally rectangular shape when viewed from above (as shown in FIG. 3). In other embodiments, the horizontal segment 72 may present another shape, such as a circle, an ellipse, a triangle, a square, a pentagon, a hexagon, an octagon, another polygon, or an irregular shape.

The left stabilizer 78 and the right stabilizer 78 each include a vertical wall 82 and a horizontal wall 84. The vertical wall 82 is configured to receive the vertical extension 74 thereon. The horizontal wall 84 is configured to receive the front strut 80 and the rear strut 80. A set of fasteners 86 may secure the vertical extension 74 to the vertical wall 82 and the struts 80 to the horizontal wall 84. The horizontal wall 84 may further present a stake opening 144 configured to receive a stake (not illustrated) therein. The stake is configured to keep the horizontal wall 84 (and, by extension, the entire agitator assembly 24) secured to the underlying surface of the body of water 12.

The vertical extension 74 rises from the horizontal segment 72. The vertical extension 74 is thus generally perpendicular to the underlying surface of the body of water 12. The vertical extension 74 may comprise a left and a right post 90. The left post 90 is secured to the left stabilizer 78 via the fasteners 86, and the right post 90 is secured to the right stabilizer 78 via the fasteners 86. In some embodiments, the left post 90 and the right post 90 are each a C-channel, such that the left post 90 and the right post 90 each include a center wall 92 disposed between two sidewalls 90.

In some embodiments, the center wall 92 of the left post 90 and the right post 90 presents a vertical step opening 96 (as best shown in FIG. 6). The vertical step opening 96 is configured to interface with the propeller housing 76 such that the propeller housing 76 may be disposed at any of various selected heights along the vertical step opening 96. The vertical step opening 96 may include a track segment 98 and a series of recess segments 100. The track segment 98 allows the propeller housing 76 to be slid up or down along the vertical step opening 96. Each of the recess segments 100 is configured to receive the propeller housing 76 therein and keep the propeller housing 76 at the respective height relative to the horizontal segment 72. An upper recess segment 100, an adjacent lower recess segment 100, and respective segment of the track segment 98 define an inner protrusion 102, as best shown in FIG. 6. The inner protrusion 102 is coplanar with the center wall 92 and protrude into the vertical step opening 96. The propeller housing 76 rests against (and may be secured to) the inner protrusion 102 to keep the propeller housing 76 at the height.

In some embodiments, the left post 90 and/or the right post 90 includes a handle segment 104. The handle segment 104 is disposed at or near a top end of the vertical extension 74. The handle segment 104 is configured to be gripped by a user so as to be lowered into or raised out of the body of water 12. In some instances, the user may be in the body of water 12 (such as in waders), in a boat, in an adjacent structure, or standing on the surface ice layer. Depending on the depth of the body of water 12, the handle segment 104 may extend up out of the water (such as illustrated in FIG. 1) or be disposed within the underlying water layer nearer the surface.

The handle segment 104 may be secured to the left post 90 and/or right post 90 or may be monolithic therewith. In some embodiments, the left post 90 and the right post 90 both include a handle segment 104 secured thereto, as best shown in FIG. 5A. The handle segment 104, in embodiments, includes a hand-receptor opening 106 with inner protrusions 108 therein. The handle segment 104 may be secured to the left post 90 and/or the right post 90 via fasteners 86. In some embodiments, the handle segment 104 is secured to the vertical step opening 96 (e.g., about one of the inner protrusions 102). As such, the handle segment 104 may be adjustable in height relative to the left post 90 and/or the right post 90.

In some embodiments, the left post 90 and/or the right post 90 includes an anchor segment 110. The anchor segment 110 is configured to receive a rope, a band, or other anchoring structure. The anchoring structure may be utilized to retrieve the agitator assembly 24, such as if the water level is too deep to retrieve the handle segment 104 by reaching into the water. The anchor segment 110 presents an annular wall configured to receive a proximal end of the anchoring structure therein. The anchoring structure may be secured, at a distal end, to the floating motor assembly 22, to the shore 14, or to some other structure.

The propeller housing 76 protects the propeller 30. Absent the propeller housing 76, the induced water flow would draw debris into the propeller 30, potentially causing damage to the rapidly rotating propeller 30. The propeller housing 76 may also interface with the vertical extension 74 to set a height and an attack angle relative to the horizontal segment 72 and/or the underlying surface.

In embodiments, the propeller housing 76 includes a cage 112 and a locking stabilizer 114. The cage 112 surrounds at least a portion of the propeller 30. The cage 112 protects the propeller 30 from damage from objects in the water. For example, plant life on the underlying surface of the body of water 12 may become tangled in the propeller 30 absent the cage 112. The cage 112 may also protect plant and animal life in the water from being damaged or killed by the propeller 30. For example, fish swimming in the body of water 12 may be pulled in toward the operating propeller 30. Absent the cage 112, the fish may be killed by the propeller 30.

The cage 112 includes a center wall 116 and a set of sidewalls 118, as illustrated in FIG. 2. Each of the center wall 116 and the sidewalls 118 includes a set of openings. The set of openings allows water to flow therethrough while preventing objects larger than the respective opening. The center wall 116 and the set of sidewalls present a void. The propeller 30 is at least partially disposed within the void. In some embodiments, the cage 112 may present a second center wall (not illustrated) downstream of the propeller 30. The collar 48 associated with the propeller 30 may be secured to the center wall 116 via fasteners 86.

The locking stabilizer 114 is configured to hold the propeller 30 at an adjustable set height above the underlying surface. Further, in embodiments, the locking stabilizer 114 is configured to hold the propeller 30 at an adjustable set attack angle relative to the underlying surface. The locking stabilizer 114 includes a tab 120 extending from the cage 112. The tab 120 interfaces with the vertical step opening 96 discussed above. The tab 120 may include a locking handle 122 which rotates relative to the tab 120. The locking handle 122 tightens and loosens the tab 120 relative to the vertical step opening 96. The user will loosen the locking handle 122, move the tab 120 out into the track segment 98, move the tab 120 up or down to a desired height relative to the horizontal segment 72, insert the tab 120 into the recess segment 100, adjust the attack angle of the cage 112, and tighten the locking handle 122.

In some embodiments, the propeller housing 76 further includes a handle segment 124. The handle segment 124 may be gripped by the user during manipulation of the location and orientation of the propeller 30. The handle segment 124 may be secured to the cage 112, or otherwise monolithic with the center wall 92 of the cage 112, as best shown in FIG. 2.

It should be appreciated that, in embodiments of the invention, the agitator assembly 24 includes no motor, controller, or other component capable of water damage. Thus, the components disposed within the water need not be excessively insulated from the water.

Exemplary Floating Motor Assembly

Figure 5B:
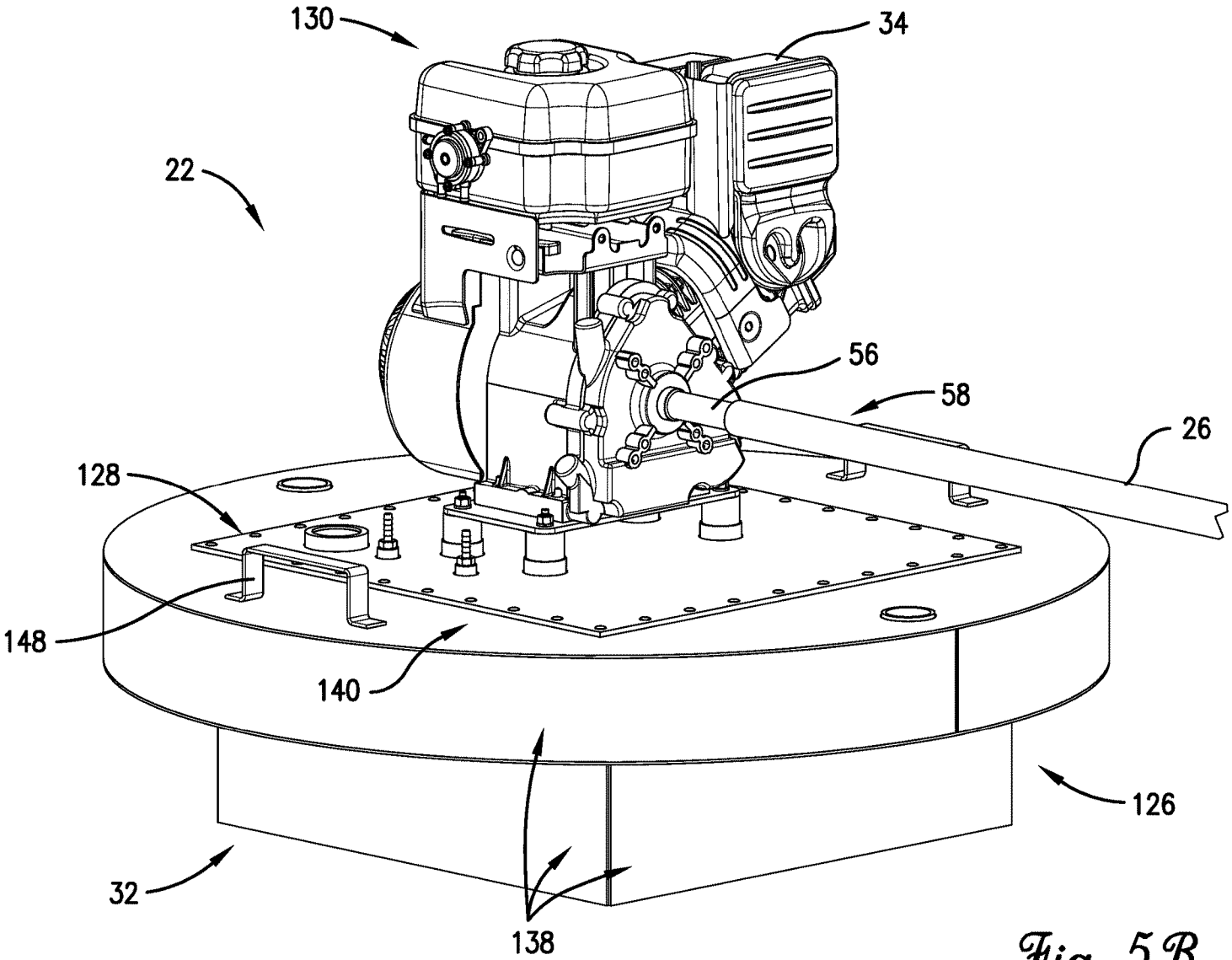
FIG. 5B is a detail perspective view of a floating motor assembly of the portable circulation de-icing system.
Figure 7:
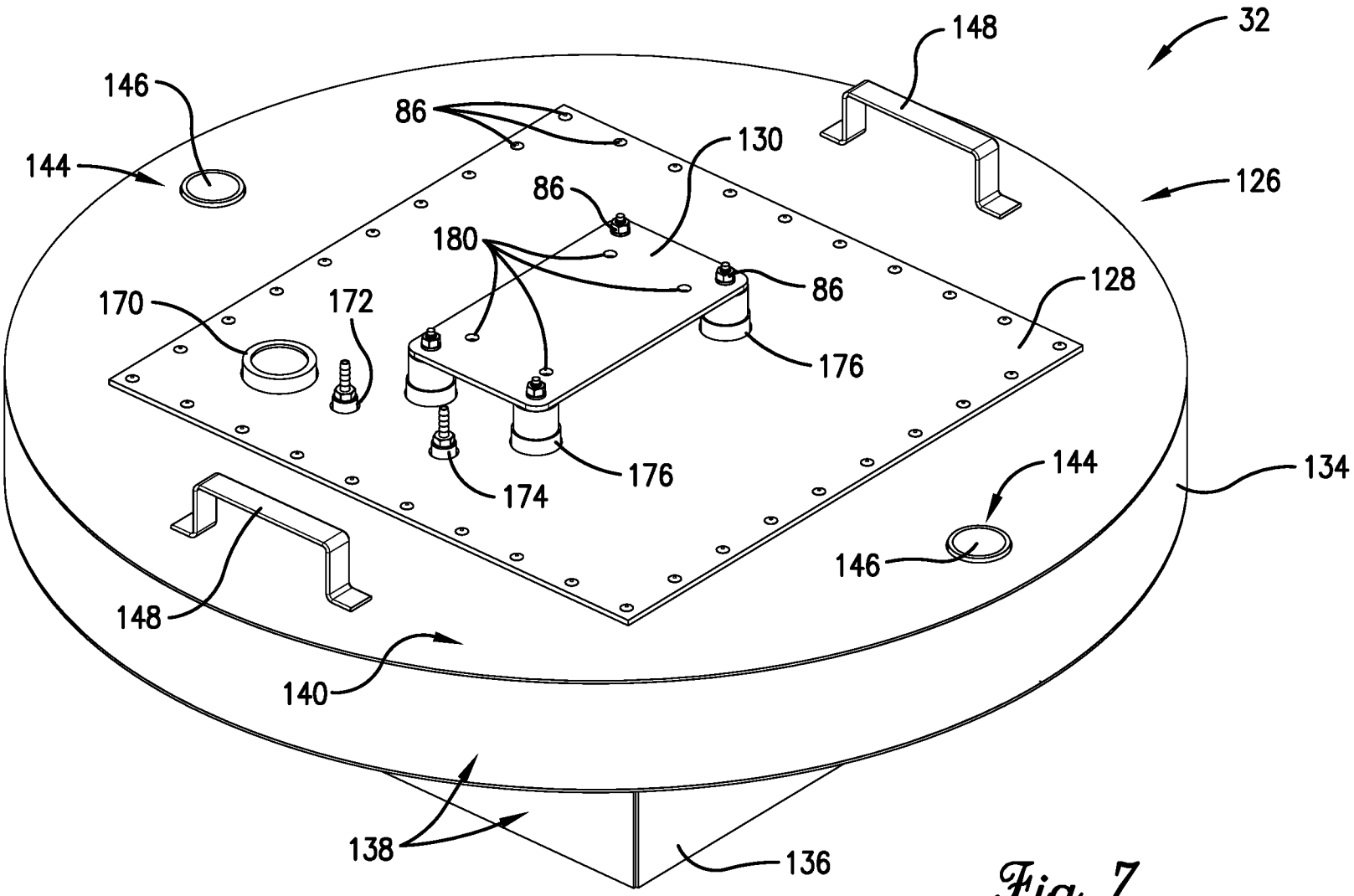
FIG. 7 is a perspective view of a floating motor platform of the floating motor assembly.

Turning to FIG. 5B, an embodiment of the floating motor assembly 22 is shown. The floating motor assembly 22 provides the rotational power that turns the flexible drive shaft 26 and thus drives the propeller 30. The floating motor assembly 22 broadly comprises a float body 126, a fuel tank 128, and a motor 34. The float body 126 provides buoyancy for the fuel tank 128 and the motor 34. The fuel tank 128 holds fuel for the motor 34. In some embodiments, such as illustrated in FIG. 7, the floating motor assembly 22 comprises the float body 126, the fuel tank 128, and a motor mount 130. This combination may be referred to as a floating motor platform 132, for example. In these embodiments, the portable circulation de-icing system 10 (or the float motor assembly 22) may be sold without the motor 34 such that the user may select a specific motor based upon the power needed for the application. Alternatively, the user may be able to purchase a motor separately from the portable circulation de-icing system 10 or utilize an existing motor. As discussed in more depth below, in some embodiments the motor 34 is an internal combustion engine and the fuel tank 128 is configured to hold a petroleum-based fuel. In other embodiments, the motor 34 is an electric motor and the fuel tank 128 is a battery configured to at least partially power the electric motor.

As shown in FIG. 1, the floating motor assembly 22 is configured to float atop the underlying water layer during operation of the portable circulation de-icing system 10. The floating motor assembly 22 keeps the motor 34 upright and out of the water. Thus, the floating motor assembly 22 provides power remotely, without relying on an external power source (other than the fuel in the fuel tank 128).

In some embodiments the float body 126 includes a peripheral float segment 134 and a lower float segment 136. The peripheral float segment 134 extends laterally to keeps the float body 126 generally aligned with the surface of the water. The lower float segment 136 provides additional buoyancy beneath the fuel tank 128. The lower float segment 136 and the peripheral float segment 134 each present one or more sidewall 138 and one or more endwall 140. In some embodiments, as shown in FIG. 5B, the peripheral float segment 134 presents a cylinder shape and the lower float segment 136 presents a rectangular prism shape. In other embodiments, not illustrated, the peripheral float segment 134 and the lower float segment 136 present other shapes (in any of various combinations) such as elliptical prisms, octagonal prisms, hexagonal prisms, triangular prisms, pyramidal frustum, conical frustum, or other shape.

Figure 8:
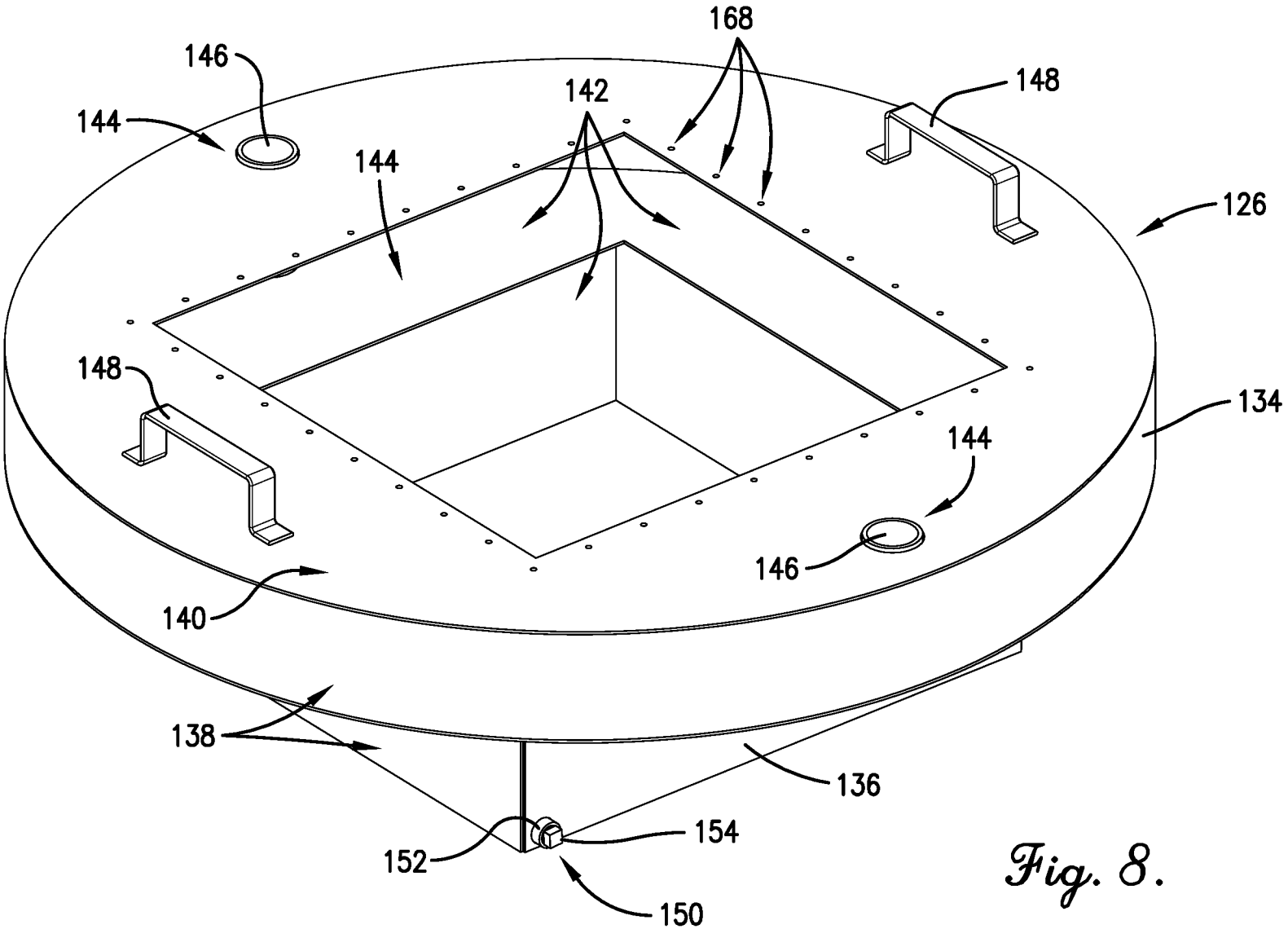
FIG. 8 is a perspective view of a float body of the floating motor assembly, having a void therein.

In embodiments, the peripheral float segment 134 and the lower float segment 136 are monolithic. In other embodiments, the peripheral float segment 134 is secured to the lower float segment 136, such as via welding or a chemical adhesive. The peripheral float segment 134 and the lower float segment 136 may be hollow, so as to present a void 142. As can be seen in FIG. 8, the void 142 may be common between both the peripheral float segment 134 and the lower float segment 136. The void 142 may be referred to as a void air compartment, as it is filled with air. The void air compartment may be compartmentalized (not illustrated) so as to prevent a leak from causing the floating motor platform 132 to sink. Additionally or alternatively, the peripheral float segment 134 and/or the lower float segment 136 may be filled with a buoyant material, such as a closed cell foam (such as polystyrene, polyurethane, or polyethylene foam) or other buoyant material. In some embodiments, the buoyant material may be disposed in a portion of the void 142.

In some embodiments, the peripheral float segment 134 and/or the lower float segment 136 includes a recess 144 (best shown in FIG. 8). The fuel tank 128 is configured to be disposed at least partially within the float body 126 (best shown in FIG. 7). The fuel tank 128 is complementary to the recess 144. In these embodiments, the fuel tank 128 is distinct from the peripheral float segment 134 and/or the lower float segment 136. In other embodiments, the fuel tank 128 is a compartment of the float body 126. In the example shown in Fig. X, the fuel tank 128 and the recess 144 are both square about a horizontal cross-section and present a general rectangular prism shape. The recess 144 may open into the void 142 discussed above, such that the fuel tank 128 occupies a portion of the void 142 when installed.

In some embodiments, the peripheral float segment 134 presents a stake opening 144 configured to receive a stake therein for securing the floating motor platform 132 relative to an underlying surface. The stake is shown in FIG. 1. The user will place the stake through the stake opening 144 and drive or push the stake into the underlying surface below the body of water 12. This will keep the floating motor assembly 22 from floating away from a desired location. Because the agitator system remains stationary in contact with the underlying surface (which may itself be staked as discussed above), the user may desire to keep the floating motor assembly 22 in an adjacent location.

In embodiments of the invention, the stake opening 144 includes a cylindrical wall 146. The cylindrical wall 146 passes between an upper side and a lower side of the peripheral float assembly. The cylindrical wall 146 allows the stake to pass between the upper side and the lower side. With the stake disposed at least partially within the cylindrical wall 146 and secured to the underlying surface, the floating motor assembly 22 cannot move laterally along the surface of the body of water 12.

In some embodiments, the peripheral float segment 134 further includes a handle 148. The handle 148 may be disposed on the upper side of the peripheral float assembly (as shown in FIGS. 5B, 7, and 8), along an exterior side, or at some other location on the peripheral float segment 134. The handle 148 may be configured such that a user may grasp and move the floating motor platform 132. The handle 148 may additionally or alternatively be configured such that the user may attach a rope, a band, or other anchoring structure. The anchoring structure may be used additionally or alternatively to the above-discussed stake.

In some embodiments, the lower float segment 136 further includes a drainage assembly 150 configured to allow water to drain from the lower float segment 136. The drainage assembly 150 includes a port 152 and a plug 154. The port 152 is permanently secured to a sidewall of the lower float segment 136. The plug 154 is configured to be selectively securely inserted into the port 152, such as via threads (not illustrated). While the plug 154 is securely emplaced in the port 152, the drainage assembly 150 is watertight, so as to prevent water from entering into or exiting out of the drainage assembly 150. When the plug 154 is removed from the port 152, water (or other liquids) may pass through the drainage assembly 150. Typically, the user will remove the plug 154 when the floating motor platform 132 is on land after operation. The user will remove the plug 154 to remove any water, fuel, or other fluid that may have accumulated in the lower float segment 136 during operation.

In some embodiments, the lower float segment 136 may include a heating element (not illustrated). The heating element may be powered (directly or indirectly) by the motor 34. The heating element may assist in creating an opening beneath the floating motor assembly 22. In these embodiments, the user may create an opening to place the agitator assembly 24 below the surface ice layer, and then place the floating motor assembly 22 on another area of the surface ice layer. The heating element will then create a second opening for the floating motor assembly 22 over time.

Figure 9:
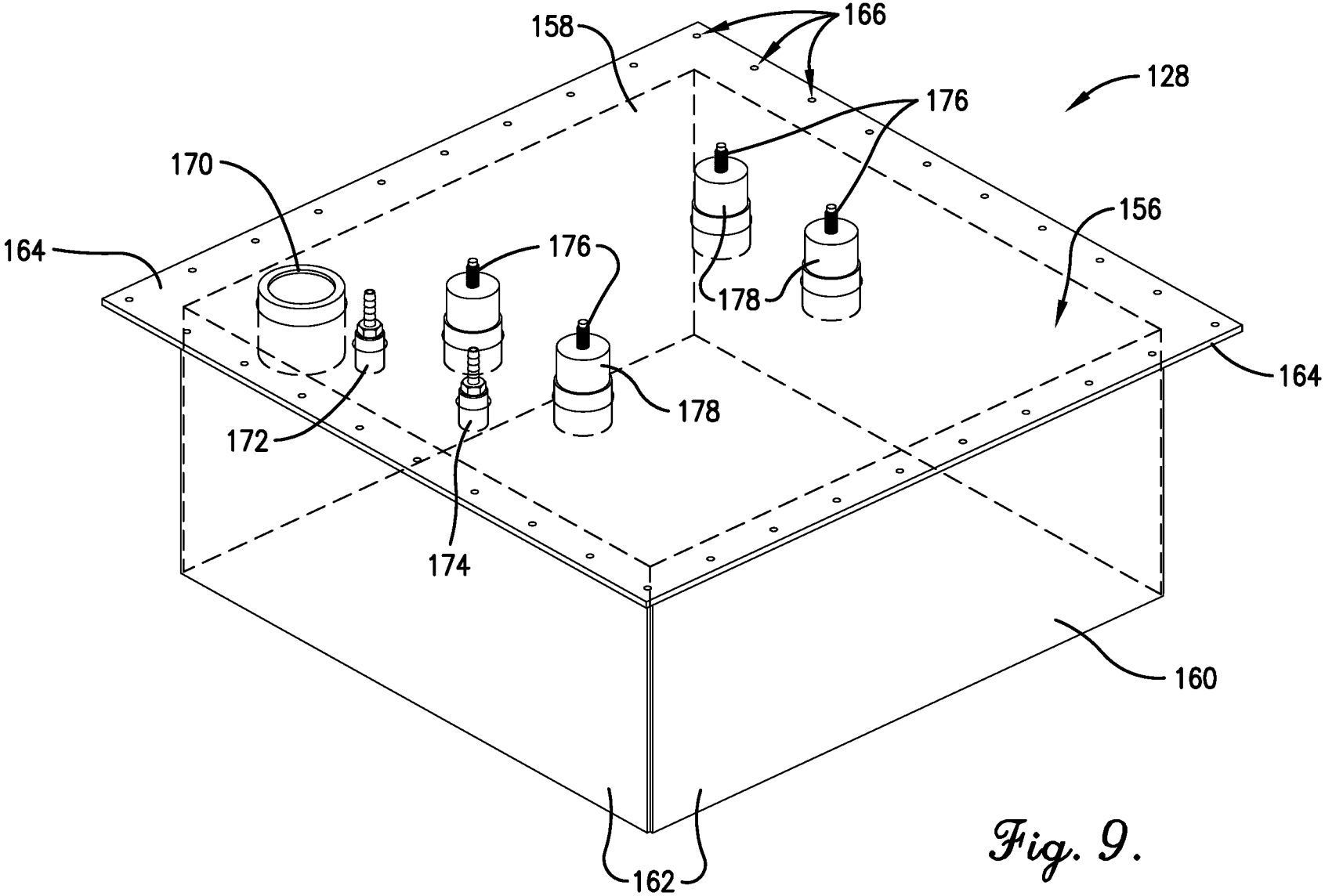
FIG. 9 is a perspective view of a fuel tank of the floating motor assembly, showing various internal components thereof.

Turning to FIG. 9, the fuel tank 128 is shown. The fuel tank 128 is configured to be disposed at least partially within the float body 126, as shown in FIG. 7. The fuel tank 128 presents a void 156 configured to receive the fuel therein. The fuel tank 128, as shown in FIG. 9, is a general square prism. The fuel tank 128 includes a top wall 158, a bottom wall 160, and a plurality of sidewalls 162. The top wall 128 includes a lip 164 that extends laterally outward. The lip 164 includes a set of upper fastener receptors 166. The upper fastener receptors 166 (shown in FIG. 9) are configured to receive a corresponding set of fasteners 86 (shown in FIG. 7) into a corresponding set of lower fastener receptors 168 (shown in FIG. 8), so as to secure the fuel tank 128 to the peripheral float segment 134.

The fuel tank 128 may include a fill port 170. The fill port 170 is selectively be opened, such that a nozzle, a spout, a funnel, or other structure may be inserted therein. The fuel will then be inserted into the fuel tank 128. The fill port 170 may be opened by removing a screw cap therefrom, or by some other opening action.

The fuel tank 128 may include a feed line port 172 and a return line port 174, as best shown in FIG. 9. The feed line port 172 and the return line port 174 are each connected to the motor 34, such that the fuel may be supplied to the motor 34. The feed line port 172 and/or the return line port 174 may include (or otherwise be associated with) a fuel pump, a fuel filter, a pressure regulator, a fuel accumulator, a fuel distributor, and inlet manifold, or other structure. These structures may condition the fuel, move the fuel, regulate pressure of the fuel, or perform other purposes associated with providing fuel to the motor 34.

The fuel tank 128 may include one or more mount feet 176, as best shown in FIG. 9. The mount feet 176 are configured to receive the motor mount 130 (shown in FIG. 7). As shown in FIG. 9, the fuel tank 128 may have four mount feet 176 disposed on the top wall 158 of the fuel tank 128. The mount feet 176 may be disposed at least partially through the fuel tank 128, so as to be securely held. The four mount feet 176 are disposed in a general rectangular shape. In other embodiments, other combinations and shapes of mount feet may be utilized.

The mount feet 176 may include a vibration dampener 178. The vibration dampener 178 includes an interior spring and a spring housing (not illustrated), or other vibration dampening structure. The spring housing surrounds and protects the spring. The mount feet are associated with the interior spring, such that vibrations and other forces imparted on the motor feet are absorbed by the interior spring. The vibration dampening structure absorbs at least a portion of vibrations from the motor 34, so as to reduce vibrations being passed to the floating motor platform 132.

In embodiments, as best shown in FIG. 7, the motor mount 130 is disposed atop the fuel tank 128. Specifically, the motor mount 130 is secured to the motor feet. The motor mount 130 may be a plate. The motor mount 130 may include a set of motor openings 180 and a set of feet openings (not directly illustrated). The set of feet openings are configured to receive the mount feet therein and to be secured by fasteners 86 (as shown in FIG. 7). The set of motor openings is configured to receive the motor 34 thereon (as shown in FIGS. 2 and 5B).

The motor mount 130 is configured to receive a motor 34 thereon for powering the de-icing system 10. In some embodiments, the motor 34 is an internal combustion engine configured to provide said rotational power. In other embodiments, not illustrated, the motor 34 is an electric motor. Examples of a motor 34 may include an internal combustion engine, a hybrid engine, an electric motor, or other power generator. Similarly, power may be provided by a battery, a solar panel, a wind turbine, or other alternate source.

In some embodiments, the motor 34 is configured to be removed from the floating motor platform 132 by removing the motor mount 130 from the mount feet 176. The motor mount 130 remains attached to the motor 34 such that the motor 34 may be selectively returned to the floating motor platform 132 as needed. The motor mount 130 may be configured to be secured to other structures. For example, the motor mount 130 may be configured to be secured to a protective cage (not illustrated) that is configured to hold the motor 34. The protective cage may support the motor 34 during land-based operations. For example, the operator may selectively switch between utilizing the floating motor platform 132 when water-based operations are needed and utilizing the protective cage when land-based operations are needed. This can be accomplished without removing the motor mount 130 from the motor 34.

Exemplary Methods of Control and Use

While various methods of using the embodiments of the invention have been discussed throughout, a method of removing ice from a body of water 12 will now be discussed. The body of water 12 has a surface ice layer and an underlying water layer. The method may include creating one or more openings in the surface ice layer. These opening (s) may be created manually (e.g., via striking with a pick or axe). The user may then enter the body of water 12 wearing waders or some other protective equipment. The user will place the agitator assembly 24 at least partially into the underlying water layer (such as shown in FIG. 1). The user will place the floating motor assembly 22 onto the underlying water layer in the opening. The opening may be the same opening of the agitator assembly 24 or another adjacent opening. The step of placing the floating motor assembly 22 is performed by setting a float body 126 of the floating motor assembly 22 into the opening such that the internal combustion engine is oriented upward and out of the underlying water layer. The user will start the motor floating motor assembly 22. The floating motor assembly 22 is configured to provide rotational power to the agitator assembly 24 via a flexible drive shaft 26. The rotational power turns a propeller 30 of the agitator assembly 24 so as to induce a water flow into the underlying water layer such that the water flow removes ice from the surface ice layer. The step of placing the agitator assembly 24 into the body of water 12 may include adjusting a set height of the propeller 30 relative to a base 28 of the agitator assembly 24 and adjusting a set attack angle of the propeller 30 relative to the base 28 of the agitator assembly 24.

The method may also include filling a fuel tank 128 of the float body 126 with fuel for the internal combustion engine, wherein the fuel tank 128 is distinct from the internal combustion engine and is disposed below the fuel tank 128.

In some embodiments, the portable circulation de-icing system 10 may include an electronic control unit that controls one or more functions of the portable circulation de-icing system 10. The electronic control unit may control the timing, rate, and other characteristics of the operation of the propeller 30.

The electronic control unit receives various inputs and/or commands and controls the operation of the propeller 30 (and may control other functions of the portable circulation de-icing system 10). The electronic control unit 100 may monitor the status and setting of various systems, such as the fuel level.

The electronic control unit 100 may also receive passive or active instructions. The user may input (directly or indirectly) requested characteristics of the operation of the portable circulation de-icing system 10. The user may be able to program specific timeframe and rate. For example, to use the hunting exemplary use, the user may emplace the portable circulation de-icing system 10 early in the morning. The user may then instruct the electronic control unit to run continuously for two hours to create the large opening to attract the waterfowl. The user may further instruct that after two hours the electronic control unit should make the portable circulation de-icing system 10 cease operations for two hours during the hunting time (so as to eliminate the noise) or switch to a low-power mode for two hours during the hunting time (so as to reduce the noise).

Based upon the above discussed inputs, the electronic control unit may determine that a change in the current operation rate is needed. The electronic control unit may send an instruction to the motor 34 to throttle, idle, cease operation, or perform some other function.

In some embodiments, the electronic control unit may be associated with a wireless communication element. The wireless communication element may allow for the remote controlling of the portable circulation de-icing system 10. The wireless communication element may utilize any of various wireless communication protocols, such as BLUETOOTH. In these embodiments, to continue the hunting exemplary usage, the hunter may remotely stop the motor 34 via the wireless communication element and the electronic control unit at various times (such as when the hunter sees waterfowl flying into the area).

Some embodiments of the invention are directed to a computerized method of controlling the portable circulation de-icing system 10. Other embodiments of the invention are directed to a portable circulation de-icing system 10 including an electronic control unit configured to control the operations of the portable circulation de-icing system 10. Still other embodiments of the invention may be directed to a non-transitory computer readable storage medium having a computer program stored thereon, wherein the computer program instructs the electronic controller unit (or other processing element(s)) to perform the above discussed steps.

Additional Considerations

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claim(s) set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in the paragraph shall apply unless so stated in this description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

I claim:

1. A portable circulation de-icing system configured to melt ice from a body of water having a surface ice layer and an underlying water layer, with an opening in the surface ice layer, comprising:

an agitator assembly configured to be at least partially placed into the underlying water layer through the opening, wherein the agitator assembly is configured to induce a water flow into the underlying water layer;

a floating motor assembly including a motor, a float body, and an internal fuel tank at least partially within the float body and distinct from the motor, wherein the floating motor assembly is configured to float on the underlying water layer in the opening, wherein the motor of the floating motor assembly is configured to provide rotational power; and a flexible drive shaft configured to transfer the rotational power from the motor to the agitator assembly.

2. The portable circulation de-icing system of claim 1, wherein the agitator assembly is configured to induce said water flow upward toward the surface ice layer.

3. The portable circulation de-icing system of claim 1, wherein the flexible drive shaft is configured to transfer rotation movement between the floating motor assembly and the agitator assembly regardless of a specific alignment between the floating motor assembly and the agitator assembly.

4. The portable circulation de-icing system of claim 1, wherein the floating motor assembly further includes:

a motor mount disposed atop the fuel tank, wherein the motor mount is configured to receive the motor thereon for powering the de-icing machine.

5. The portable circulation de-icing system of claim 1, wherein the motor is an internal combustion engine configured to provide said rotational power.

6. The portable circulation de-icing system of claim 1, wherein the agitator assembly further includes:

a propeller configured to be actuated by the rotational power from the floating motor assembly; and a base supporting the propeller above an underlying surface below the underlying water layer.

7. The portable circulation de-icing system of claim 6, wherein the base is configured to hold the propeller at an adjustable set height above the underlying surface, wherein the base is configured to hold the propeller at an adjustable set attack angle relative to the underlying surface.

8. A method of removing ice from a body of water having a surface ice layer and an underlying water layer, the method comprising:

creating an opening in the surface ice layer;

placing an agitator assembly at least partially into the underlying water layer;

placing a floating motor assembly having an internal fuel tank onto the underlying water layer in the opening, wherein the motor assembly is configured to provide rotational power to the agitator assembly via a flexible drive shaft; and starting the floating motor assembly such that the rotational power turns a propeller of the agitator assembly so as to induce a water flow into the underlying water layer such that the water flow removes ice from the surface ice layer.

9. The method of claim 8, further comprising:

adjusting a set height of the propeller relative to a base of the agitator assembly; and adjusting a set attack angle of the propeller relative to the base of the agitator assembly.

10. The method of claim 8, further comprising:

starting an internal combustion engine of the floating motor assembly so as to provide said rotational power.

11. The method of claim 10, wherein the step of placing the floating motor assembly is performed by setting a float body of the floating motor assembly into the opening such that the internal combustion engine is oriented upward and out of the underlying water layer.

12. The method of claim 11, further comprising:

filling the fuel tank of the float body with fuel for the internal combustion engine, wherein the fuel tank is distinct from the internal combustion engine.

13. A floating motor platform for a de-icing system comprising:

a float body;

an internal fuel tank disposed at least partially within the float body; and a motor mount disposed atop the internal fuel tank, wherein the motor mount is configured to receive a motor thereon for powering the de-icing machine.

14. The floating motor platform of claim 13, wherein the motor mount includes a vibration dampener between fuel tank and the motor.

15. The floating motor platform of claim 13, wherein the float body includes a peripheral float segment and a lower float segment, wherein the peripheral float segment includes a recess wherein the fuel tank disposed at least partially within the float body.

16. The floating motor platform of claim 15, wherein the peripheral float segment presents a stake opening configured to receive a stake therein for securing the floating motor platform relative to an underlying surface.

17. The floating motor platform of claim 15, wherein the peripheral float segment further includes a handle such that a user may grasp and move the floating motor platform, wherein the lower float segment further includes a drainage hole configured to allow water to drain from the lower float segment.

* * * * *